US008829372B1

(12) United States Patent
Rhein

(10) Patent No.: US 8,829,372 B1
(45) Date of Patent: Sep. 9, 2014

(54) AIR BREAK ELECTRICAL SWITCH HAVING A BLADE OPEN/CLOSED INDICATOR

(75) Inventor: David A. Rhein, St. Jacob, IL (US)

(73) Assignee: Power Products, LLC, Menomonee Falls, WI (US)

( * ) Notice: Subject to any disclaimer, the term of this patent is extended or adjusted under 35 U.S.C. 154(b) by 261 days.

(21) Appl. No.: 13/406,232

(22) Filed: Feb. 27, 2012

Related U.S. Application Data

(60) Provisional application No. 61/449,444, filed on Mar. 4, 2011.

(51) Int. Cl.
*H01H 31/00* (2006.01)

(52) U.S. Cl.
USPC ..... 200/48 SB

(58) Field of Classification Search
USPC ..... 200/401, 400, 288, 50.19, 50.02, 410, 200/411, 430, 431, 428, 440–442, 318, 321, 200/324, 325, 327, 335, 6 R, 600, 48 P
See application file for complete search history.

(56) References Cited

U.S. PATENT DOCUMENTS

| | | | | |
|---|---|---|---|---|
| 3,956,721 | A | | 5/1976 | Link |
| 4,116,157 | A | | 9/1978 | Evans |
| 4,160,890 | A | * | 7/1979 | Chard et al. ..... 200/308 |
| 4,645,888 | A | | 2/1987 | Barkan et al. |
| 5,276,288 | A | | 1/1994 | Erickson et al. |
| 5,293,012 | A | * | 3/1994 | Levi ..... 200/48 P |
| 5,764,472 | A | * | 6/1998 | Schuld ..... 361/602 |
| 5,912,604 | A | | 6/1999 | Harvey et al. |
| 5,950,550 | A | | 9/1999 | Luxon |
| 7,579,571 | B2 | | 8/2009 | Siebens et al. |
| 7,739,978 | B2 | | 6/2010 | Beckman et al. |
| 2010/0116365 | A1 | | 5/2010 | McCarty |

* cited by examiner

*Primary Examiner* — Edwin A. Leon
*Assistant Examiner* — Anthony R. Jimenez
(74) *Attorney, Agent, or Firm* — Michael Best & Friedrich LLP

(57) ABSTRACT

An air break electrical switch includes a first electrical terminal and a second electrical terminal supported apart from the first electrical terminal. The switch further includes a blade support configured to be electrically insulatively supported apart from the second electrical terminal. A blade is pivotally supported by the blade support, and the blade is pivotable from an open contact position to a closed contact position and vice versa. The switch further includes an indicator connected to the blade. At least a portion of the indicator is fixed to the blade so as to rotate with the blade and display a first color when the blade is in the open contact position and obscure the first color when the blade is in the closed contact position.

20 Claims, 9 Drawing Sheets

AIR BREAK ELECTRICAL SWITCH HAVING A BLADE OPEN/CLOSED INDICATOR

CROSS-REFERENCE TO RELATED APPLICATION

This application claims the benefit of U.S. Provisional Patent Application No. 61/449,444 filed Mar. 4, 2011, the disclosure of which is hereby incorporated by reference for all purposes.

STATEMENT CONCERNING FEDERALLY SPONSORED RESEARCH OR DEVELOPMENT

Not applicable.

FIELD OF THE INVENTION

This invention relates to high voltage/high current air break switches, particularly switches that indicate whether a pivotable blade is in an open or closed position.

BACKGROUND OF THE INVENTION

High voltage/high current air break switches typically include an elongated conductive contact or "blade" that engages an electrical terminal to establish an electrical connection. Depending on the voltage difference between the blade and the electrical terminal, electrical arcing can occur and potentially damage contact surfaces of the blade and the electrical terminal if the blade moves slightly out of contact with the terminal. As such, some previous air break switch designs locked or otherwise secured the blade to the electrical terminal during operation to inhibit arcing. With some of these designs, the locking components applied relatively large holding forces on the blade, and these large forces needed to be overcome to properly engage the blade with the electrical terminal.

To address the drawbacks of these high-locking force designs, other previous designs included blades that could be closed by exerting relatively low forces. With some of these designs, rotating an operating mechanism (e.g., and elongated shaft extending to the ground) would first cause the blade to pivot about a vertical axis and enter the electrical terminal. Continued rotation of the operating mechanism would then pivot the blade about its longitudinal axis and move the contact surfaces into engagement with the electrical terminal.

However, it can be difficult for an operator standing on the ground to observe longitudinal rotation of the blade even if the switch is mounted at a relatively low height on a utility structure. As such, it can be difficult to determine if the blade has established a proper electrical connection with the electrical terminal. If the blade does not properly engage the electrical terminal, potentially-damaging arcing can occur as described above.

Considering the drawbacks of previous designs, a need exists for an improved air break switch that indicates whether a pivotable blade is in an open or closed position.

SUMMARY OF THE INVENTION

In one aspect, the present invention provides an air break electrical switch comprising a first electrical terminal configured to be electrically insulatively supported by a utility structure and a second electrical terminal configured to be electrically insulatively supported by the utility structure apart from the first electrical terminal. The switch further comprises a blade support configured to be electrically insulatively supported by the utility structure apart from the second electrical terminal. A blade is pivotally supported by the blade support, and the blade is pivotable from an open contact position to a closed contact position and vice versa. In the open contact position contacts of the blade are spaced apart from the second electrical terminal. In the closed contact position the contacts engage the second electrical terminal to electrically connect the first electrical terminal and the second electrical terminal. The switch further comprises an indicator connected to the blade. At least a portion of the indicator is fixed to the blade so as to rotate with the blade and display a first color when the blade is in the open contact position and obscure the first color when the blade is in the closed contact position.

In another aspect, the present invention provides an air break electrical switch comprising a first electrical terminal configured to be electrically insulatively supported by a utility structure and a second electrical terminal configured to be electrically insulatively supported by the utility structure apart from the first electrical terminal. The switch further comprises a blade support configured to be electrically insulatively supported by the utility structure apart from the second electrical terminal. A blade is pivotally supported by the blade support, and the blade is pivotable from an open contact position to a closed contact position and vice versa. In the open contact position contacts of the blade are spaced apart from the second electrical terminal. In the closed contact position the contacts engage the second electrical terminal to electrically connect the first electrical terminal and the second electrical terminal. An indicator is fixed to one of the blade supports and the blade, and the indicator has a first portion and a second portion. An obscuring member is fixed to the other of the blade supports and the blade and overlies the indicator. The obscuring member has a plurality of apertures such that the indicator is visible therethrough. In the open contact position the first portion of the indicator is visible through the apertures in the obscuring member to indicate that the blade is in the open contact position.

In yet another aspect, the present invention provides an air break electrical switch comprising a first electrical terminal configured to be electrically insulatively supported by a utility structure and a second electrical terminal configured to be electrically insulatively supported by the utility structure apart from the first electrical terminal. A blade support is configured to be electrically insulatively supported by the utility structure apart from the second electrical terminal. A blade is pivotally supported by the blade support, and the blade is pivotable from an open contact position to a closed contact position and vice versa. In the open contact position contacts of the blade are spaced apart from the second electrical terminal. In the closed contact position the contacts engage the second electrical terminal to electrically connect the first electrical terminal and the second electrical terminal. The switch further comprises an indicator fixed to one of the blade supports and the blade, and the indicator has a first portion. An obscuring member is fixed to the other of the blade supports and the blade and overlies the indicator. In the closed contact position the first portion of the indicator is obscured by the obscuring member to indicate that the blade is in the closed contact position.

The foregoing and other objects and advantages of the invention will appear in the detailed description which follows. In the description, reference is made to the accompanying drawings which illustrate a preferred embodiment of the invention.

BRIEF DESCRIPTION OF THE DRAWINGS

The invention will hereafter be described with reference to the accompanying drawings, wherein like reference numerals denote like elements, and.

DETAILED DESCRIPTION OF THE PREFERRED EMBODIMENT

Figure 1:
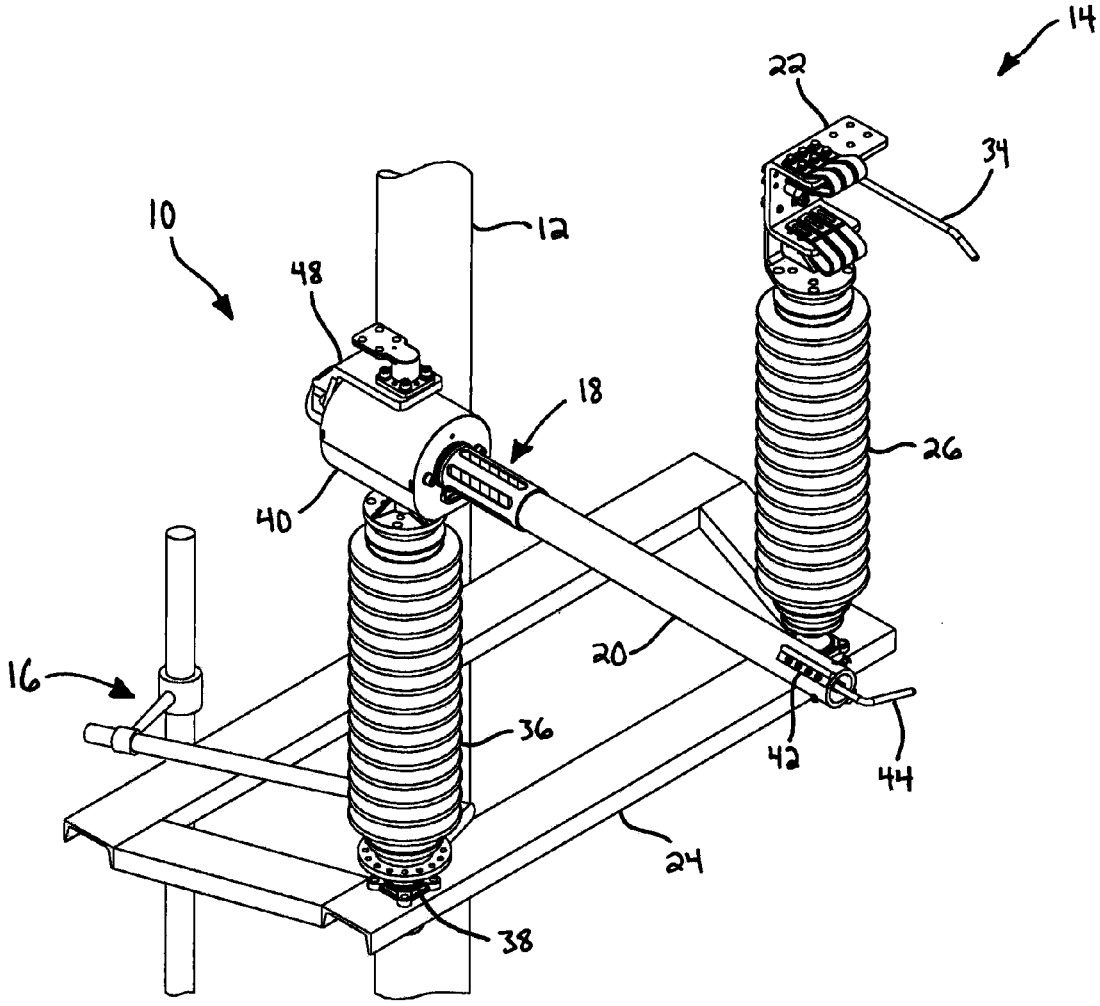
FIG. 1 is a perspective view of an air break switch according to the present invention in an open blade position.

Referring first to FIG. 1, a high voltage/high current electrical or air break switch 10 of the present invention may be supported by various types of appropriate utility structures, such as a simple elongated utility pole 12. The switch 10 includes one or more upper switches 14 disposed above the ground and an operating mechanism 16 extending from the upper switch 14 toward the ground. The operating mechanism 16 may be driven by an electrical technician on the ground to move the upper switch 14 between different operating positions. Unlike previous designs, the present switch 10 includes an open/closed indicator assembly 18 that indicates whether an electrically conductive blade 20 is in proper engagement with a distal electrical terminal 22. These aspects are described in further detail in the following paragraphs, beginning with a general description of the upper switch 14 and concluding with a description of the indicator assembly 18.

Referring now to FIGS. 1-4, the upper switch 14 may be a low-actuating force air break switch as described in U.S. Provisional Patent Application No. 61/434,263, U.S. Pat. No. 2,810,799, U.S. Pat. No. 3,836,737, U.S. Pat. No. 5,584,379, U.S. Pat. No. 3,134,865, U.S. Pat. No. 4,078,162, the disclosures of which are hereby incorporated by reference in their entirety, or one commercially available from Turner Electric Company, Edwardsville, Ill. The upper switch 14 may also take other forms that are not explicitly listed above or described as follows.

In the embodiment shown in the figures, the upper switch 14 includes a support frame 24 fixedly connected to the utility pole 12. The support frame 24 mounts both stationary and pivotable switch components. Regarding the stationary switch components, a first end of the support frame 24 mounts a first elongated insulator 26 such as a ceramic insulator. The first insulator 26 supports the distal electrical terminal 22 above the frame 24 and, as such, the distal electrical terminal 22 is electrically isolated from the frame 24.

Figure 4:
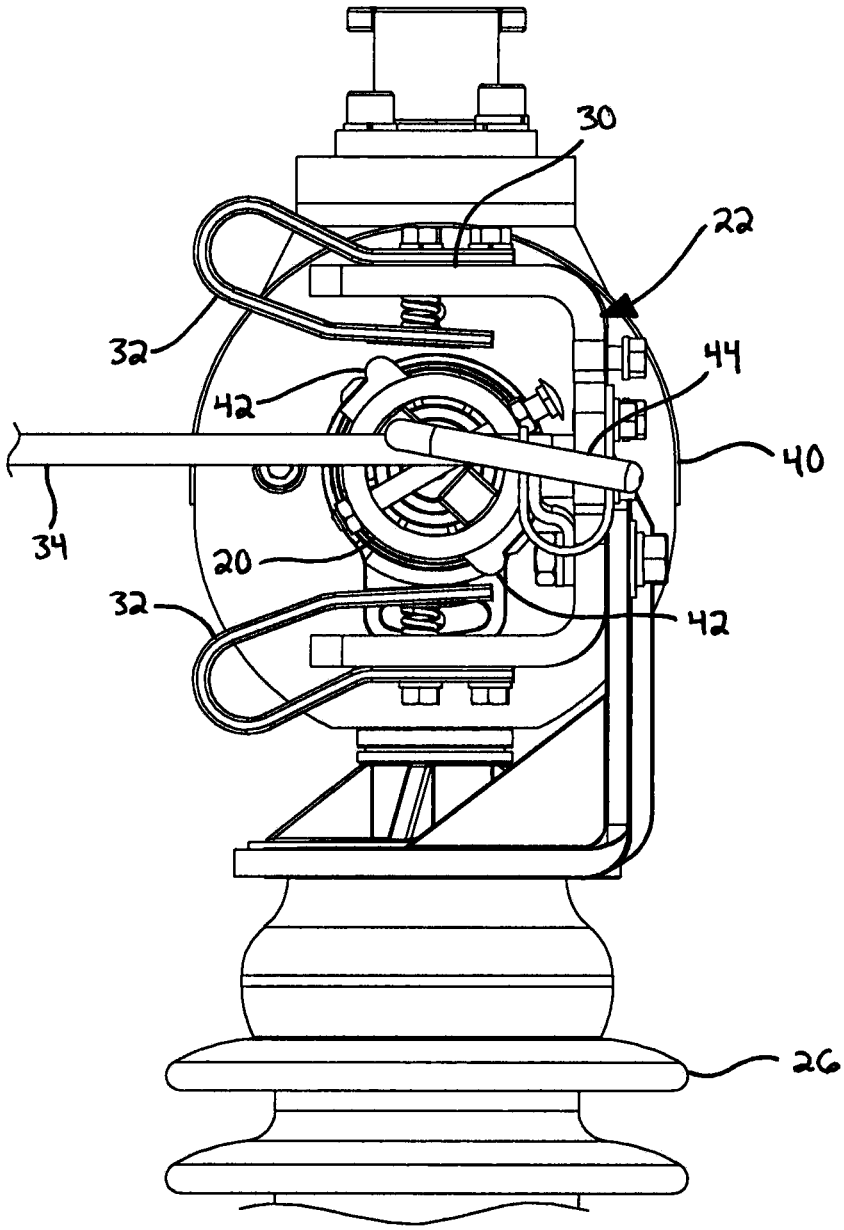
FIG. 4 is a side view of the air break switch of FIG. 1 in the closed blade position and the open contact position.

Referring specifically to FIG. 4, the distal electrical terminal 22 includes a conductor contact 30 for connection to another electrical conductor, such as a transmission wire (not shown). The electrical terminal 22 also includes one or more terminal contacts 32. The terminal contacts 32 are preferably arranged in upper and lower pairs and each contact 32 in a pair is spring-biased toward the other contact 32 in the pair. This structure permits the terminal contacts 32 to engage the blade 20 as described in further detail below.

The distal electrical terminal 22 may also include a first arcing arm 34 (FIGS. 1 and 2) to prevent electrical arcing at the terminal contacts 32. Furthermore, the first electrical terminal 22 may also support a load interrupter (not shown), such as the load interrupter described in U.S. Pat. No. 4,492,835, the disclosure of which is hereby incorporated by reference in its entirety, or one commercially available from Turner Electric Company, Edwardsville, Ill. The electrical terminal 22 may also support a corona shield (not shown).

Returning to FIGS. 1-4 and regarding the pivotable switch components, the support frame 24 also mounts a second elongated insulator 36, such as a ceramic insulator, opposite the first insulator 26. The second insulator 36 is pivotably connected to the support frame 24, e.g., via a bearing assembly 38. In addition, the second insulator 36 connects to the operating mechanism 16 and is pivoted thereby as described in further detail below. The second insulator 36 also mounts a blade support 40 and the blade 20.

Rotating the operating mechanism 16 pivots the second insulator 36 about a vertical axis. As such, the operating mechanism 16 pivots the blade 20 from an open blade position (FIG. 1) in which the blade 20 is spaced apart from the electrical terminal 22 to a closed blade position (FIG. 2) in which the blade 20 enters the electrical terminal 22 and vice versa. Specifically, pivoting the operating mechanism 16 in a first direction (i.e., clockwise as viewed from above) drives the blade 20 toward the closed blade position, and pivoting the operating mechanism 16 in a second direction (i.e., counterclockwise as viewed from above) drives the blade 20 toward the open blade position.

Figure 5:
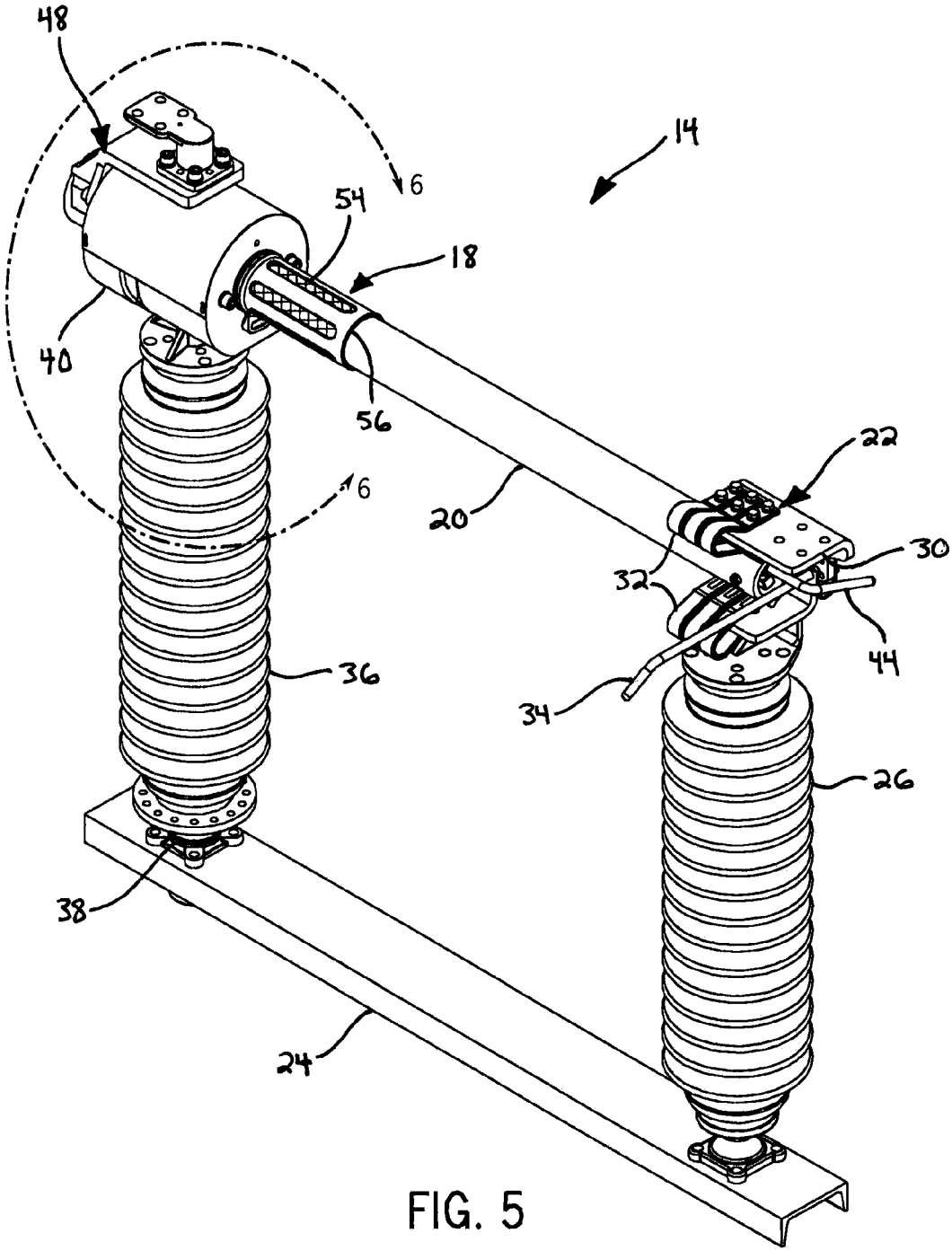
FIG. 5 is a perspective view of the air break switch of FIG. 1 in a closed contact position.

The blade support 40 mounts the blade 20 such that the blade 20 is pivotable about its longitudinal axis from an open contact position (FIGS. 2-4) to a closed contact position (FIGS. 5-7) and vice versa. As the name implies, in the closed contact position, contacts 42 on the end of the blade 20 proximate the electrical terminal 22 engage the terminal contacts 32 to electrically connect the electrical terminal 22 and the blade 20. Conversely, in the open contact position, the blade contacts 42 disengage the terminal contacts 32, although the electrical terminal 22 and the blade 20 may still be electrically connected by contact between the first arcing arm 34 and a second arcing arm 44 supported by the blade 20.

Figure 2:
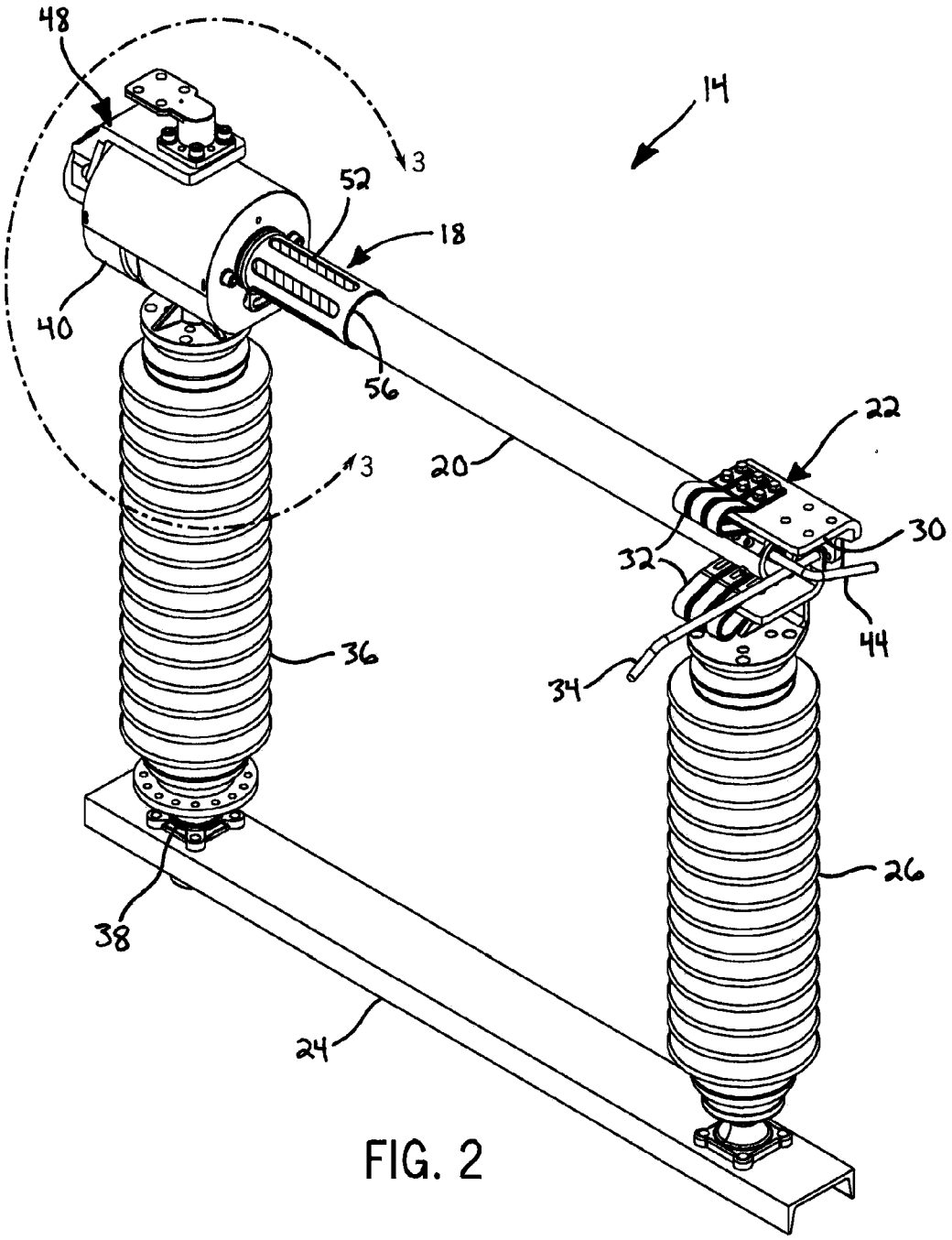
FIG. 2 is a perspective view of the air break switch of FIG. 1 in a closed blade position and an open contact position.
Figure 3:
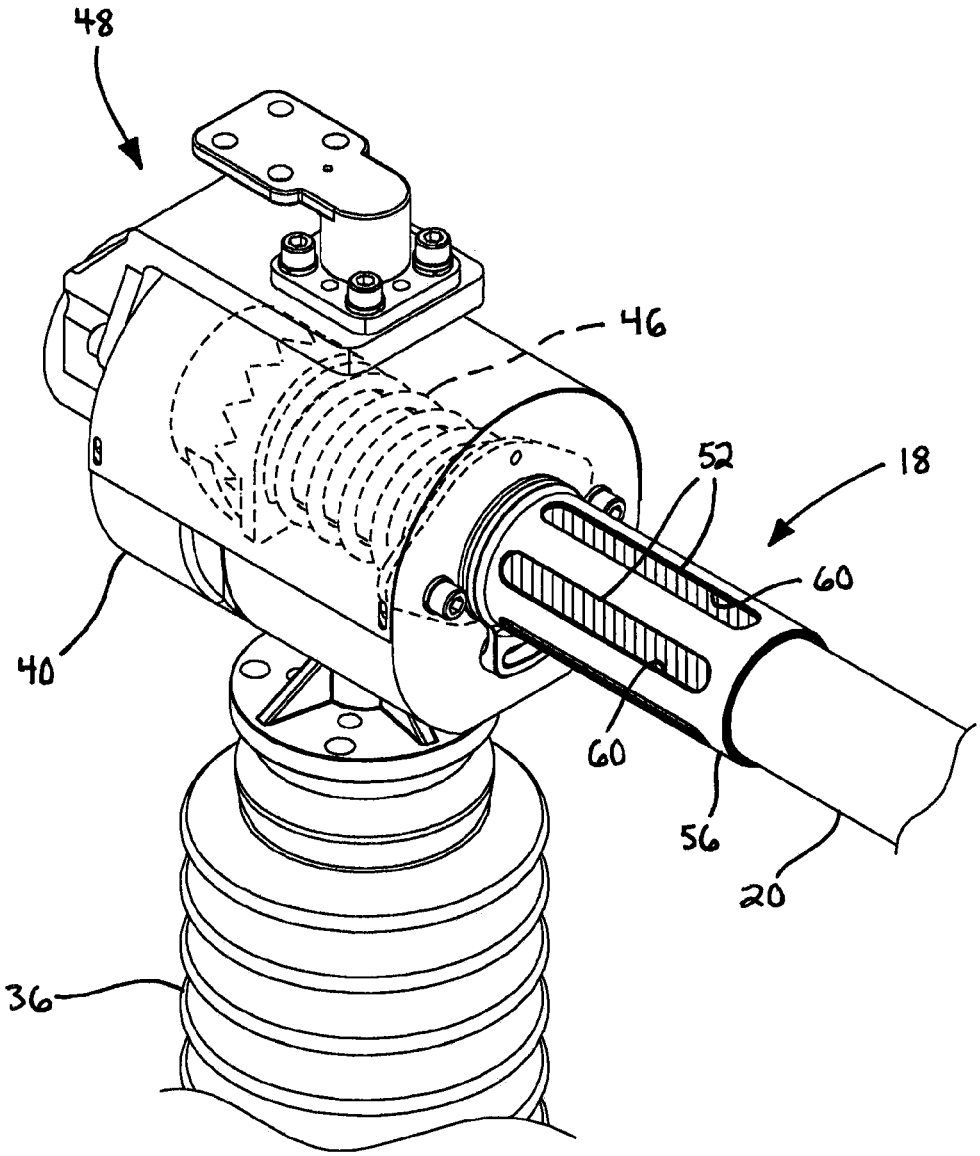
FIG. 3 is a detail view of the air break switch enclosed by line 3-3 of FIG. 2.

To facilitate the motion of the blade 20 described in the previous paragraph, the blade support 40 houses a toggle mechanism 46 (FIG. 3) that pivots the blade 20 due to pivotal motion of the operating mechanism 16. In addition, the toggle mechanism 46 inhibits the blade 20 from rotating about the vertical axis unless the blade 20 is pivoted about its longitudinal axis to the open contact position (FIGS. 2 and 3). The specific construction of the toggle mechanism 46 may be as described in U.S. Provisional Patent Application No. 61/434,263, although other constructions may alternatively be used.

Still referring to FIGS. 1-4, the blade support 40 also mounts and the blade 20 electrically conductively connects to a proximal electrical terminal 48. As such, the blade 20 is pivotable to electrically connect the proximal electrical terminal 48 and the distal electrical terminal 22.

Figure 6:
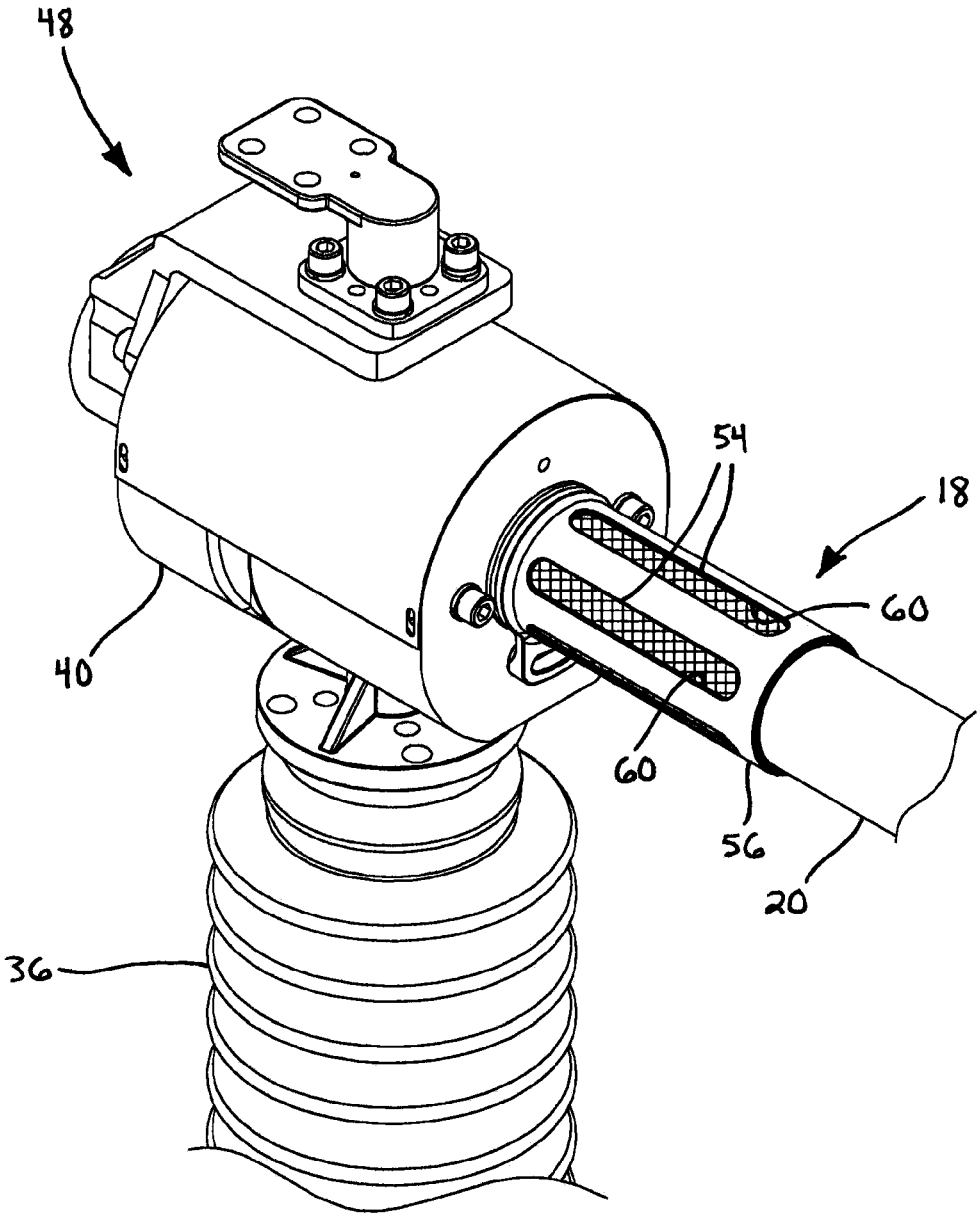
FIG. 6 is a detail view of the air break switch enclosed by line 6-6 of FIG. 5.
Figure 7:
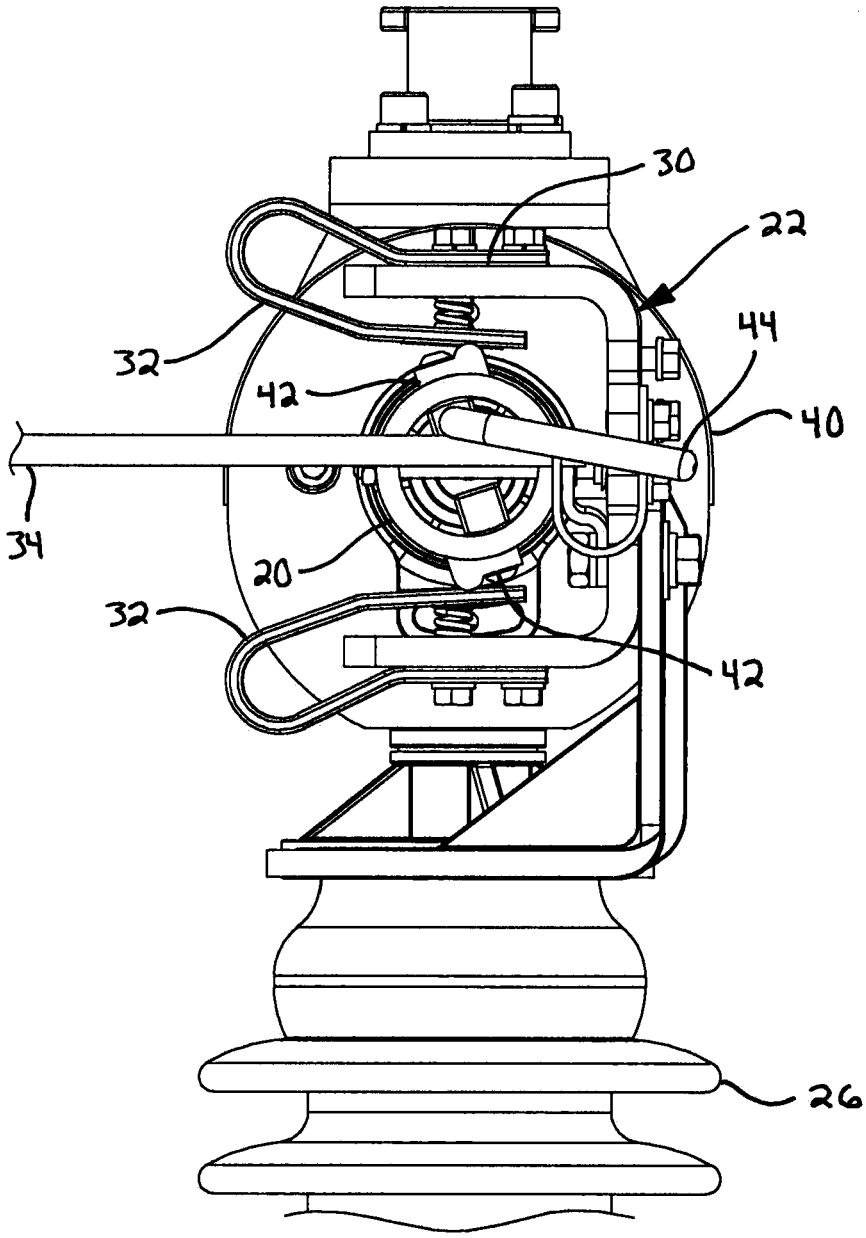
FIG. 7 is a side view of the air break switch of FIG. 1 in the closed contact position.
Figure 8:
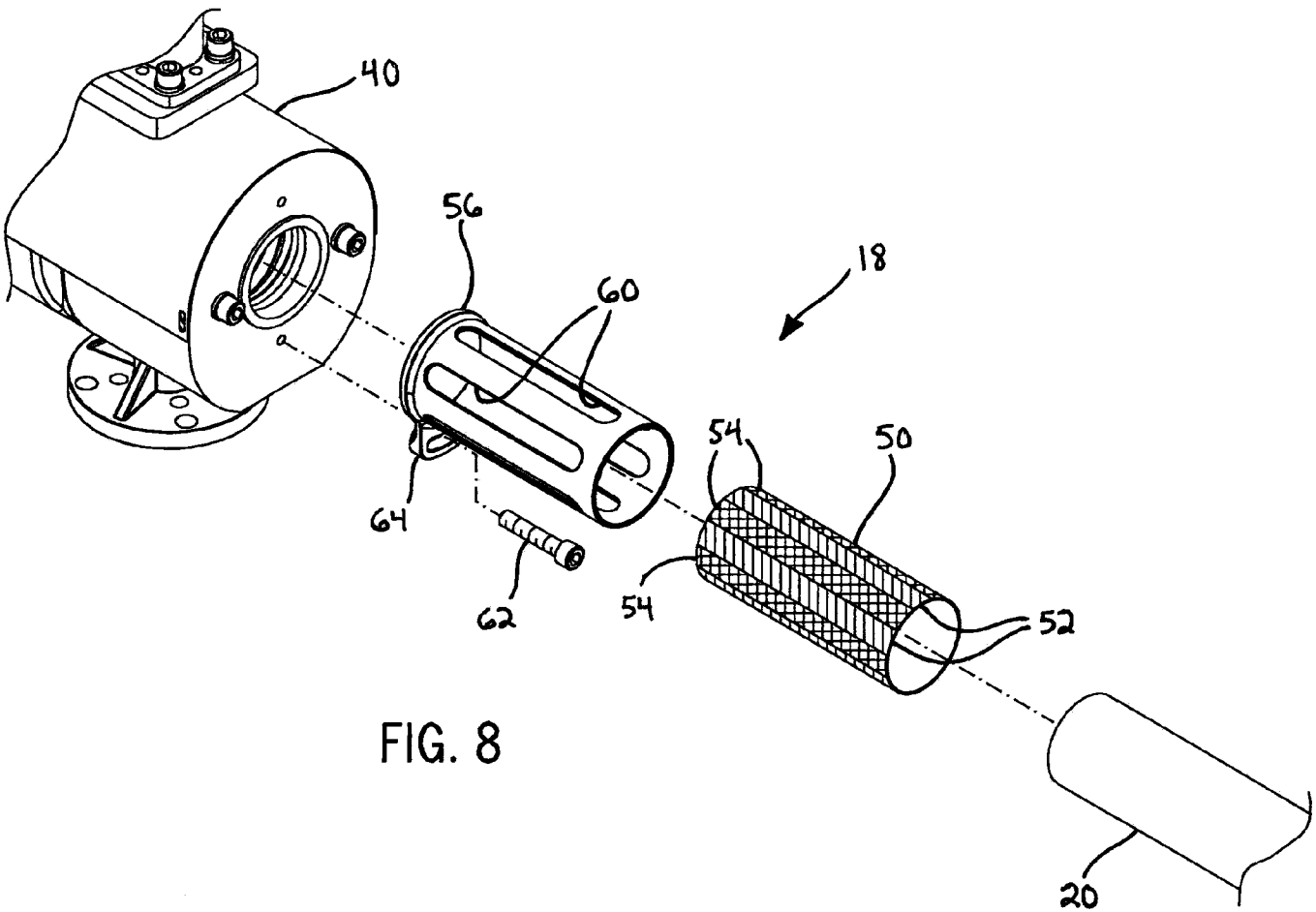
FIG. 8 is a partially exploded perspective view of a blade, an open/closed indicator assembly, and a blade support of the switch of FIG. 1.
Figure 9:
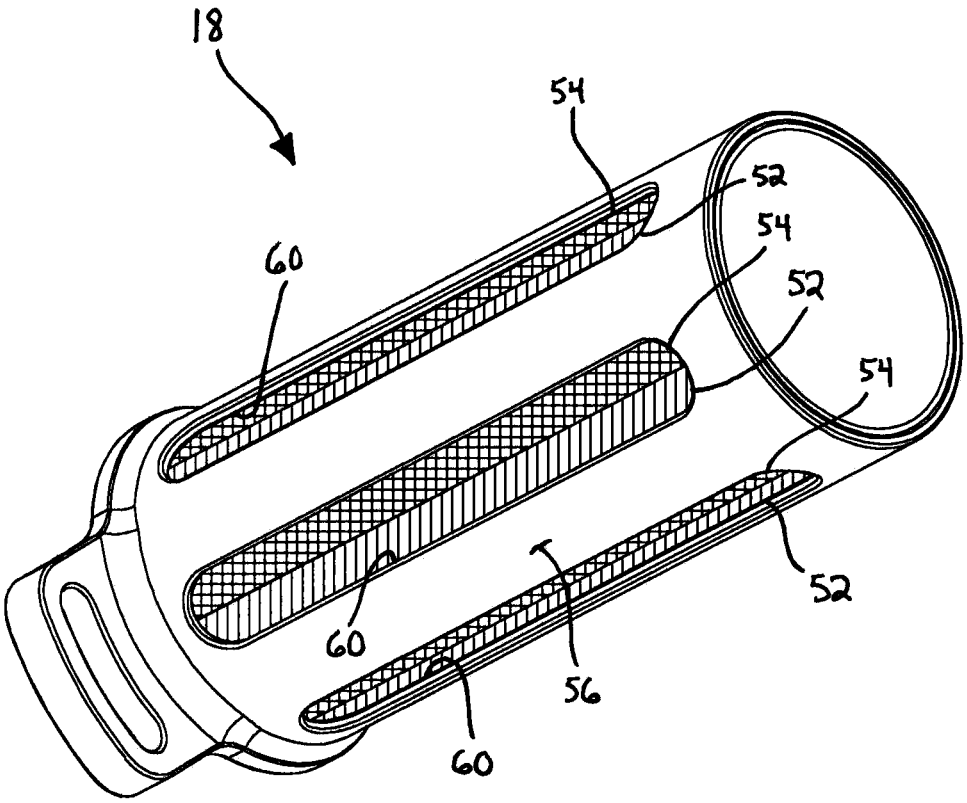
FIG. 9 is a perspective view of the indicator assembly of the switch of FIG. 1.

Turning now to FIGS. 3, 6, 8, and 9, the open/closed indicator assembly 18 will now be described in further detail. The indicator assembly 18 includes an elongated indicator tube or sleeve 50 (FIG. 8) that is fixed to the blade 20 and, as such, rotates therewith relative to the blade support 40. The indicator 50 includes a plurality of colored portions or stripes 52, 54 that are selectively displayed depending on whether the blade 20 is in the open contact position or closed contact position. An obscuring member 56 fixed to the blade support 40 and surrounding the indicator 50 facilitates appropriate display of the stripes 52, 54. Specifically, the first colored portion or stripes 52 of the indicator 50 are visible through elongated apertures 60 in the obscuring member 56 and the second colored portion or stripes 54 are obscured by the obscuring member 56 when the blade 20 is in the open contact position (FIG. 3). Conversely, the first stripes 52 are obscured by the obscuring member 56 and the second stripes 54 are visible through the apertures 60 when the blade 20 is in the closed contact position (FIG. 6).

The first stripes 52 are preferably a relatively bright color, such as red, to represent that the switch 10 is open and the blade 20 is not in a proper operating position. Other colors may alternatively be used, such as, black, white, or bright colors having a wavelength of at least 550 nm that are visible even in relatively poor lighting conditions. The second stripes 54 are preferably a relatively dark color, such as black, that has a relatively high contrast to the first color 52 and cannot be easily mistaken for the first color 52. Other colors may alternatively be used, such as white, or colors having an 8-bit grayscale value of at most 96.

In addition, each of the first stripes 52 is preferably angularly disposed between two of the second stripes 54 and spaced about the indicator 50 at equal angles from one another, such as approximately 30 degrees. Similarly, each of the apertures 60 is preferably spaced about the obscuring member 56 at equal angles from one another, such as approximately 30 degrees. This construction permits an operator standing on the ground to see at least one of the apertures 60 and at least a portion of the indicator 50 at various angles and even relatively large distances from the switch 10. Further still, the stripes 52, 54 and the apertures 60 preferably have an angular width that is approximately equal to the angle over which the blade 20 pivots about its longitudinal axis. Such a configuration ensures that only a single color is visible in both the open and closed contact positions. In the embodiment shown in the figures, the angular width is approximately 30 degrees.

The indicator 50 and the obscuring member 56 preferably comprise materials such as plastic or aluminum. Other materials may be used without departing from the spirit of the invention. The indicator 50 may be fixed to the blade 20 in various manners, such as via an adhesive, and the obscuring member 56 may be fixed to the blade support 40 in various manners, such as via a threaded fastener 62 (FIG. 8) extending through a flange 64.

In addition to the alternatives described above, the construction of the switch 10 may also be modified in other manners. For example, in some embodiments the indicator 50 may be fixed to the blade support 40 and the obscuring member 56 may be fixed to the blade 20. As another example, in some embodiments the apertures 60 may have disposed therein transparent windows (not shown) or other types of panels covering the indicator 50 provided that the stripes 52, 54 are visible therethrough. As yet another example, the switch 10 could be a double side break switch (i.e., wherein the blade 20 extends from both ends of the blade support 40 and contacts electrical terminals spaced apart from the blade support 40) including indicator assemblies 18 on both sides of the blade support 40. As yet another example, the stripes 52, 54 could be of any colors, including black and white.

Preferred embodiments of the invention have been described in considerable detail. Many modifications and variations to the preferred embodiments described will be apparent to a person of ordinary skill in the art. Therefore, the invention should not be limited to the embodiments described, but should be defined by the claims that follow.

I claim:

1. An air break electrical switch, comprising:

a first electrical terminal configured to be electrically insulatively supported by a utility structure;

a second electrical terminal configured to be electrically insulatively supported by the utility structure apart from the first electrical terminal;

a blade support configured to be electrically insulatively supported by the utility structure apart from the second electrical terminal;

a blade pivotally supported by the blade support, the blade being pivotable from an open contact position to a closed contact position and vice versa, in the open contact position contacts of the blade being spaced apart from the second electrical terminal and in the closed contact position the contacts engaging the second electrical terminal to electrically connect the first electrical terminal and the second electrical terminal; and an indicator connected to the blade, at least a portion of the indicator being fixed to the blade so as to rotate with the blade and display a first color when the blade is in the open contact position and obscure the first color when the blade is in the closed contact position.

2. The air break electrical switch of claim 1, wherein the at least a portion of the indicator displays a second color when the blade is in the closed contact position and obscures the second color when the blade is in the open contact position.

3. The air break electrical switch of claim 2, wherein the indicator includes a first plurality of stripes having the first color and a second plurality of stripes having the second color.

4. The air break electrical switch of claim 3, wherein the first plurality of stripes are spaced about the indicator at equal angles from one another such that the first color is visible from a plurality of angles about the blade in the open contact position.

5. The air break electrical switch of claim 1, wherein the blade support houses a toggle mechanism that is actuatable to pivot the blade relative to the blade support.

6. An air break electrical switch, comprising:

a first electrical terminal configured to be electrically insulatively supported by a utility structure;

a second electrical terminal configured to be electrically insulatively supported by the utility structure apart from the first electrical terminal;

a blade support configured to be electrically insulatively supported by the utility structure apart from the second electrical terminal;

a blade pivotally supported by the blade support, the blade being pivotable from an open contact position to a closed contact position and vice versa, in the open contact position contacts of the blade being spaced apart from the second electrical terminal and in the closed contact position the contacts engaging the second electrical terminal to electrically connect the first electrical terminal and the second electrical terminal;

an indicator fixed to the blade, the indicator having a first portion and a second portion;

an obscuring member fixed to the blade support and overlying the indicator, the obscuring member having a plurality of apertures such that the indicator is visible therethrough; and wherein in the open contact position, the first portion of the indicator is visible through the apertures in the obscuring member to indicate that the blade is in the open contact position.

7. The air break electrical switch of claim 6, wherein in the closed contact position, the second portion of the indicator is visible through the apertures in the obscuring member to indicate that the blade is in the closed contact position.

8. The air break electrical switch of claim 6, wherein the first portion of the indicator comprises a plurality of stripes of a first color and the second portion of the indicator comprises a plurality of stripes of a second color, the second color being different than the first color.

9. The air break electrical switch of claim 8, wherein the first color has a wavelength of at least 550 nm and the second color has an 8-bit grayscale value of at most 96.

10. The air break electrical switch of claim 8, wherein the plurality of stripes of the first color are spaced about the indicator at equal angles from one another such that the indicator is visible from a plurality of angles about the blade in the open contact position.

11. The air break electrical switch of claim 8, wherein the blade pivots over an angle to move from the open contact position to the closed contact position and vice versa, each of the plurality of stripes of the first color has an angular width, and the angular width is approximately equal to the angle.

12. The air break electrical switch of claim 6, wherein the blade is pivotable about a first axis from an open blade position to a closed blade position and vice versa, in the open blade position the blade being spaced apart from the second electrical terminal, and in the closed blade position the blade being pivotable about a second axis from the open contact position to the closed contact position and vice versa.

13. The air break electrical switch of claim 12, wherein in the open blade position, the first portion of the indicator is visible through the apertures in the obscuring member.

14. An air break electrical switch, comprising:

a first electrical terminal configured to be electrically insulatively supported by a utility structure;

a second electrical terminal configured to be electrically insulatively supported by the utility structure apart from the first electrical terminal;

a blade support configured to be electrically insulatively supported by the utility structure apart from the second electrical terminal;

a blade pivotally supported by the blade support, the blade being pivotable from an open contact position to a closed contact position and vice versa, in the open contact position contacts of the blade being spaced apart from the second electrical terminal and in the closed contact position the contacts engaging the second electrical terminal to electrically connect the first electrical terminal and the second electrical terminal;

an indicator fixed to the blade, the indicator having a first portion;

an obscuring member fixed to the blade support and overlying the indicator; and wherein in the closed contact position the first portion of the indicator is obscured by the obscuring member to indicate that the blade is in the closed contact position.

15. The air break electrical switch of claim 14, wherein the obscuring member has a plurality of apertures such that the indicator is visible therethrough, and in the open contact position the first portion of the indicator is visible through the apertures to indicate that the blade is in the open contact position.

16. The air break electrical switch of claim 15, wherein in the closed contact position, a second portion of the indicator is visible through the apertures in the obscuring member to further indicate that the blade is in the closed contact position.

17. The air break electrical switch of claim 16, wherein the first portion of the indicator comprises a plurality of stripes of a first color and the second portion of the indicator comprises a plurality of stripes of a second color, the second color being different than the first color.

18. The air break electrical switch of claim 16, wherein in the open contact position, the second portion of the indicator is obscured by the obscuring member to further indicate that the blade is in the open contact position.

19. The air break electrical switch of claim 14, wherein the first portion of the indicator comprises a plurality of stripes of a first color and a second portion of the indicator comprises a plurality of stripes of a second color, the second color being different than the first color.

20. The air break electrical switch of claim 19, wherein the plurality of stripes of the first color are spaced about the indicator at equal angles from one another such that the indicator is visible from a plurality of angles about the blade.

* * * * *